US006142311A

United States Patent [19]

Körber

[11] Patent Number: 6,142,311

[45] Date of Patent: Nov. 7, 2000

[54] PROCESS FOR CONTROLLING A SAND AND GRAVEL SORTING AND SIZING DEVICE

[75] Inventor: Rolf Körber, Essen, Germany

[73] Assignee: Allmineral Aufb ereitungstechnikBmbH & Co KG, Germany

[21] Appl. No.: 09/230,596

[22] PCT Filed: Jul. 19, 1997

[86] PCT No.: PCT/DE97/01568

§ 371 Date: Mar. 30, 1999

§ 102(e) Date: Mar. 30, 1999

[87] PCT Pub. No.: WO98/04353

PCT Pub. Date: Feb. 5, 1998

[30] Foreign Application Priority Data

Sep. 26, 1996 [DE] Germany ..... 196 30 085

[51] Int. Cl.[7] ..... B03B 5/52

[52] U.S. Cl. ..... 209/454; 209/208; 209/172; 209/172.5; 209/173; 209/422; 209/155

[58] Field of Search ..... 209/208, 155, 209/3, 172, 172.5, 173, 454, 488, 489, 490, 491, 494, 495, 496, 497, 499

[56] References Cited

U.S. PATENT DOCUMENTS 4,533,464 8/1985 Smith et al. .

FOREIGN PATENT DOCUMENTS 0 508 335 A2 10/1992 European Pat. Off. .
27 55 681 6/1979 Germany .
41 18 020 A1 12/1992 Germany .

OTHER PUBLICATIONS

"Zum Einstaz von Aufstromklassierern für die Aufbereitung kontaminierter Baggerschlämme"; vol. 31, No. 11, Nov. 1990; pp. 593–601.

*Primary Examiner*—Donald P. Walsh
*Assistant Examiner*—Jonathan R. Miller
*Attorney, Agent, or Firm*—Robert W. Becker & Associates

[57] ABSTRACT

In a process for controlling the product composition in an apparatus for sizing and sorting mineral raw materials, wherein the apparatus comprises at least one chamber, a sizing separation of the sand fraction into a sand product mass and into a micro particle sand fraction to be discharged via the overflow, is additionally performed in the chamber by means of the level of the fluidized bed in the chamber. For the adjustment of a pre-set concentration of micro particle sand in the sand product mass, the fluidized bed level is controlled such that the micro particle sand fraction in the supplied raw material mass is divided, by means of the fluidized bed, as a function of the pre-set admissible concentration into a micro particle sand fraction to be discharged into the sand product mass and a micro particle sand fraction to be discharged via the overflow. For all geometrically similar constructive designs of the apparatus, the fixed yield distribution, defined as a ratio of the micro particle sand fraction to be removed to the micro particle sand fraction in the supplied raw material mass, is predetermined as a function of the fluidized bed level in the form of a calibration curve as a parameter specific to the apparatus. Based on the calibration curve, the fluidized bed level, correlated to the required yield distribution as a function of the determined micro particle sand content in the supplied raw material mass, is derived as a set value for the level adjustment of the fluidized bed.

8 Claims, 6 Drawing Sheets

PROCESS FOR CONTROLLING A SAND AND GRAVEL SORTING AND SIZING DEVICE

BACKGROUND OF THE INVENTION

The invention relates to a process for the control of the product composition in an apparatus for sizing and sorting mineral raw materials, in particular sand or gravel, comprising a feed means for the raw material feed and at least one chamber serving for the separation of the low density materials from the sand product fraction, further comprising a sand product removal device and an overflow for low density materials, wherein the chamber is designed as a sorting region according to the fluidized bed process in order to sort the raw material feed. An apparatus in accordance with the aforementioned characteristics for the separation of low density materials from sand and gravel is described in the brochure "MAB Fluidized Bed Sorter-Hydrosort I" of the firm Schauenburg Maschinen-und Anlagen-Bau GmbH; in this apparatus the raw material feed, composed of sand of different particle size, is introduced into the cylindrical single-chamber receptacle comprising a substantially flat bottom and discharge means provided therein for the purified sand. The single chamber receptacle is supplied with upwardly flowing water at the bottom so that in the single chamber receptacle, utilizing the fine fractions of sand contained in the raw material feed, a fluidized bed is generated having a very high turbidity and causing organic impurities, in particular, severely carbonized wood, contained in the raw material feed, to float so that the impurities as well as slurry like micro particles are flushed out with the overflow water.

Additionally, a dual chamber design, comprising an interior chamber serving as a coarse sand chamber for the separation of the coarse sand and an exterior chamber as a fine sand chamber serving for sorting the fine sand according to the fluidized bed process and connected to the coarse sand chamber via an overflow, designed as an inclined surface, and further comprising an overflow for low-density materials associated with the exterior chamber, is described in EP 0 508 335 A2, operating according to the same principle, with regard to the purification of the fine sand, since in a first step the coarse sands may be separated as a product fraction without specific purification due to a set particle size limit.

For apparatus of this type it is now required that the content of micro particle sand in the particular overall sand product mass concerned should not exceed a predetermined percentage and should preferably be in the range of a determined concentration in relation to the particular sand product mass; such a requirement can, however, not be met by operating the afore described apparatus of one or the other embodiment.

It is therefore the object of the invention to provide a process for the control of the product composition in an apparatus having the aforementioned features by which a predetermined concentration of micro particle sand is realized in the sand product mass.

SUMMARY OF THE INVENTION

The solution of this problem, including advantageous embodiments and further developments of the invention, is apparent from the contents of the patent claims which follow this description.

In its basic concept the invention suggests that, additionally, a sizing separation of the sand fraction into a sand product mass and into a micro particle sand fraction to be discharged via the overflow, is to be performed in the chamber via the fluidized bed level of the fluidized bed present in the chamber and that for the adjustment of a pre-set concentration of micro particle sand in the sand product mass the fluidized bed level is so adjusted that the micro particle sand content in the supplied raw material mass can be divided, by means of the fluidized bed as a function of the pre-set admissible concentration, into a micro particle sand portion to be discharged into the sand product mass and into a micro particle sand portion to be discharged via the overflow. In this context, for all geometrically similar constructive designs of the apparatus, a fixed yield distribution, defined as a ratio of the micro particle sand fraction to be removed to the micro particle sand content in the supplied raw material mass, is predetermined as a function of the fluidized bed level in the form of a calibration curve as a parameter specific to the apparatus. Based on the calibration curve, the fluidized bed level, corresponding to the required yield distribution as a function of the determined micro particle sand content in the supplied raw material mass, is derived as a set value for the level adjustment of the fluidized bed present in the chamber.

Accordingly, a first process step includes, apart from the sorting effect of the fluidized bed in the receptacle, to utilize the fluidized bed furthermore for sizing and to adjust a particle size for the overflow between a fine sand fraction and a fine sand fraction to be discharged via the overflow. While the fine sand fraction is to remain entirely in the removed product, a predetermined portion of the micro particle sand fraction present in the raw material feed, is to be introduced, as a function of the sand product mass, into the sand product mass to be discharged via the receptacle bottom as an amount corresponding to the predetermined concentration, wherein the excess portion of micro particle sand is to be discharged via the overflow. For this purpose the inventive process employs the now realized, surprising effect that with the aid of the fluidized bed not only the adjustment of a particle size limit per se is possible but that, depending on the other constructive specifications of the chamber design, also a quantitative distribution of the entire micro particle sand fraction can be set up by way of the fluidized bed level of the fluidized bed in the receptacle. For this purpose, the yield distribution of micro particle sand may be used as a apparatus-specific parameter in the form of a calibration so that after determination of the overall micro particle sand content in the raw material feed, the particular fluidized bed level, required for the desired amount of micro particle sand to be discharged together with the fine sand, may be derived.

Since for the inventive process guidance may be obtained from generally valid dirnension-analytical test results of geometrically comparable apparatus, the invention has the advantage that, on the one hand, the inventive process can be carried out independently of the particle composition of the amount of raw material feed and that, furthermore, the sand product mass need not be analyzed constantly.

Insofar as the process is applied to a single chamber receptacle comprising a fluidized bed, only a single sand product mass results for this receptacle as a measured variable and as a basis for the concentration required for the micro particle content. In a dual-chamber design according to EP 0 508 335 A2, the sand product mass is composed of the partial amount withdrawn from the coarse sand chamber and the partial amount withdrawn from the fine sand chamber, whereby the micro particle sand portion to be introduced into the sand product mass is discharged via the fine sand chamber. Accordingly, the total sand product mass results from the combination of two partial amounts.

According to a first embodiment, the invention suggests to directly determine the micro particle sand content in the raw material feed as a starting value by taking samples and by performing a particle size analysis of the sample taken. When knowing the micro particle sand portion in the raw material feed, it is then possible in alternative method steps, to either directly determine the fluidized bed level as a set value and to determine the degree of the required re-adjustment by comparison with the measured actual value, or an approximation of the measured actual value of the fluidized bed level to the set value, corresponding to the required yield distribution, is realized by a respectively set amount of re-adjustment for the fluidized bed level.

A further possibility, without determining the particle size composition in the raw material feed, according to one embodiment of the invention, resides in that the yield distribution is determined as a function of the amounts measured for the raw material feed and/or the sand product mass and/or the micro particle sand mass discharged via the overflow and that the fluidized bed level is derived as the set value as a function of the yield distribution, wherein measuring of the mass flows may preferably be performed by in-line belt scales.

According to one embodiment of the invention, the particle size limit between the micro particle sand fraction and the fine sand fraction is 0,25 mm.

BRIEF DESCRIPTION OF THE DRAWINGS

In the drawing embodiments of the invention are represented which will be explained in the following. It is shown in.

DESCRIPTION OF PREFERRED EMBODIMENTS

Figure 1:
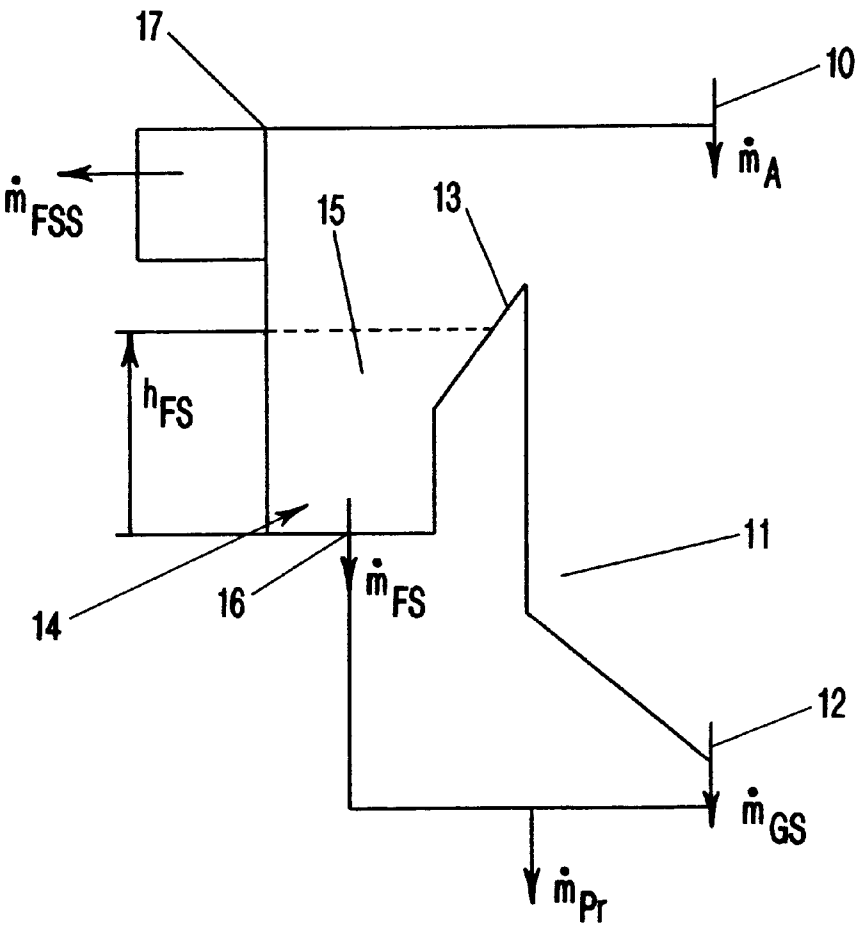
FIG. 1 a schematic representation of the correlation of the mass balance in a dual-chamber apparatus embodied according to EP 0 508 335 A2.

FIG. 1 partially illustrates the apparatus described in detail in EP 0 508 335 A2; in this respect reference is made to EP 0 508 335 A2 with regard to the operation of the apparatus.

In the apparatus provided, a mass flow $\dot{m}_A$ flows through a feeding array 10, reaching a coarse sand chamber 11 from where a coarse sand mass $\dot{m}_{GS}$ is removed via a discharge device 12. The fine sand particles and the micro particle sand particles reach the fine sand chamber 14 via the overflow 13 where the fluidized bed 15 having a fluidized bed level $h_{FS}$ is present. The fine sand mass flow $\dot{m}_{FS}$ is withdrawn via the discharge device 16 while the micro particle sand particles, separated, for example, at a separation limit of 0.25 mm, are discharged via the overflow 17 as mass flow $\dot{m}_{FSS}$. The corresponding solid material mass balance in the apparatus is thus $$\dot{m}_A=\dot{m}_{GS}+\dot{m}_{FS}+\dot{m}_{FSS}$$

resulting in the sand product mass $$\dot{m}_{PR}=\dot{m}_{GS}+\dot{m}_{FS}=\dot{m}_A-\dot{m}_{FSS}$$

As a set value, the operator of the apparatus requires a micro particle sand concentration in the sand product mass $C_{<Prsoll}$, resulting from the ratio of the micro particle sand content $m_{<PR}$ in the product to the entire sand product mass:

$$C_{<Pr} = \frac{\dot{m}_{<Pr}}{\dot{m}_{Pr}}$$

The total micro particle sand fraction $\dot{m}_{<A}$ contained in the raw material feed is to be divided into the micro particle sand content $\dot{m}_{<PR}$ contained in the sand product mass $\dot{m}_{Pr}$ and into the micro particle sand content $\dot{m}_{FSS}$ (FIG. 1) to be discharged via the overflow 17. This micro particle content $\dot{m}_{FSS}$ may also be defined as loss of micro particles in the sand product mass, yielding a dimensionless loss factor of $$V = \frac{\dot{m}_{FSS}}{\dot{m}_{<A}}$$

The process is based on the realization that the aforementioned loss factor V, corresponding to the micro particle sand mass $\dot{m}_{FSS}$ discharged via the overflow 17, can be determined as a parameter specific to the apparatus as a function of the fluidized bed level $h_{FS}$ of the fluidized bed 15 and may then be used as a set value in the form of a calibration curve for apparatus of comparable configuration. This dependence of the loss factor V on the fluidized bed level $_{FS}$ can be illustrated as a graph denoted by the reference numeral 18 in each of the flow diagrams according to FIGS. 2 to 4. This calibration curve can be employed in all apparatus having similar geometries and, therefore, must not be determined for each individual apparatus for which the geometry and the dimensions of the respective chamber can be enlarged or reduced by a scaling factor.

Figure 2:
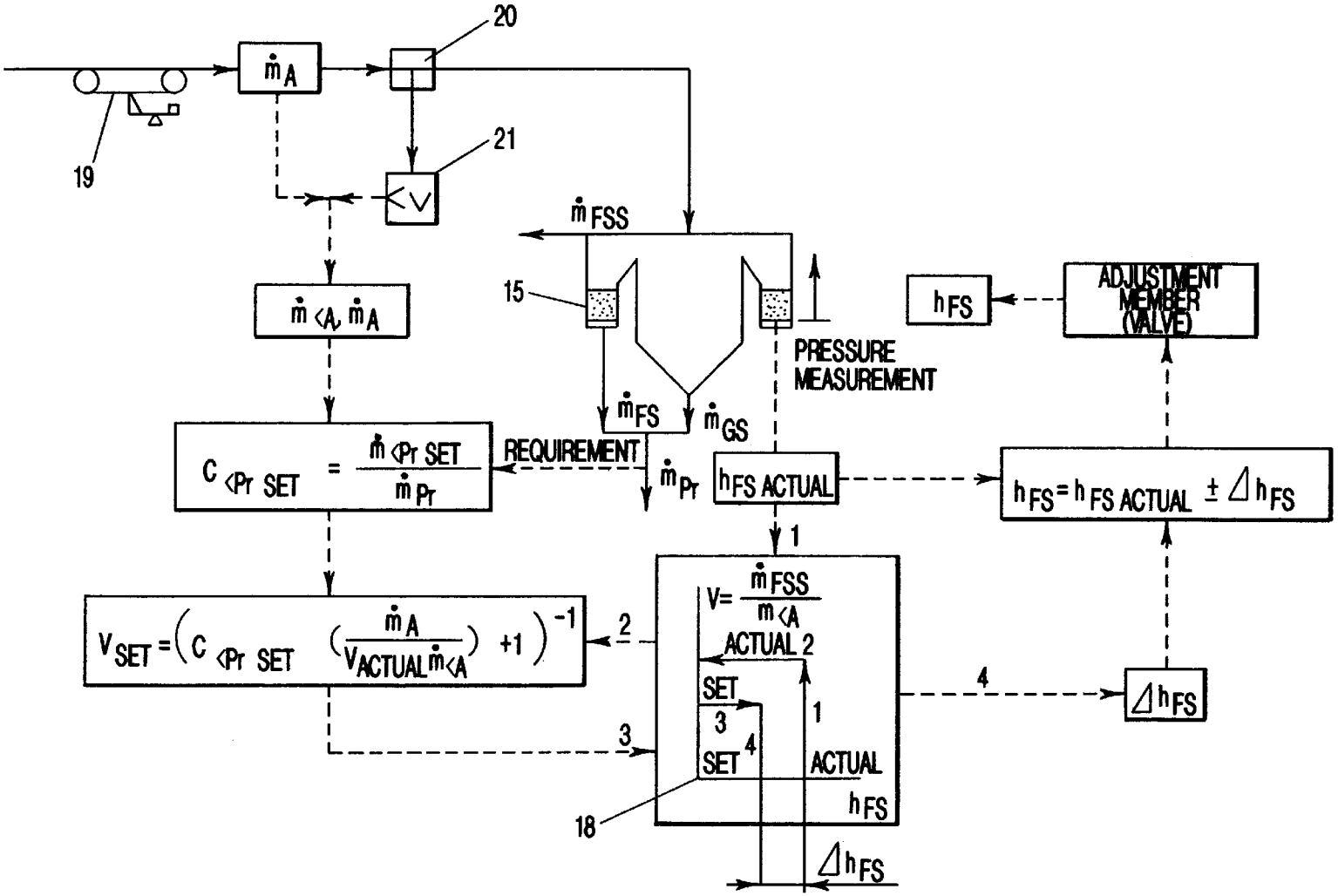
FIG. 2 a diagrammatic flow chart of the formation of the fluidized bed level for the micro particle sand content in the raw material feed, determined by particle size analysis, for an apparatus represented in FIG. 1.

In the embodiment of the inventive process illustrated in FIG. 2, the mass flow of the raw material feed $\dot{m}_A$ is determined by a belt scale 19. Furthermore, samples are taken therefrom by the sampler 20 and in a suitable device 21 the particle size distribution of the raw material feed is obtained for a particle size limit of 0.25 mm so that the entire mass content of micro particle sand, having a particle size smaller than 0.25 mm, in the raw material feed $\dot{m}_{<A}$ is known.

The amount of micro particle sand $\dot{m}_{FSS}$ discharged via the overflow 17 is likewise determined, as well as the amount of sand product $\dot{m}_{Pr}$ as sum total of the respective mass flows withdrawn from the fine sand chamber 14 and the coarse sand chamber 11. Finally, by means of appropriate measuring the fluidized bed level $h_{FS}$ is also measured as the actual value for the momentary state of the apparatus.

In the flow chart illustrated in FIG. 2, the correlations are illustrated in detail, the sequence of the control steps being illustrated in the individual diagram 18.

By means of the measured actual value for the fluidized bed level $h_{FS}$ an actual value for the loss factor V is to be determined, wherein the set value for the loss factor can be calculated on the basis of the desired concentration. By means of the set value for the loss factor, the set value for the fluidized bed level $h_{FS}$ is to be determined so that between the actual value and the set value a $\Delta h_{FS}$ results. By means of this $\Delta h_{FS}$ the actual value for the fluidized bed level must then be readjusted accordingly.

Figure 3:
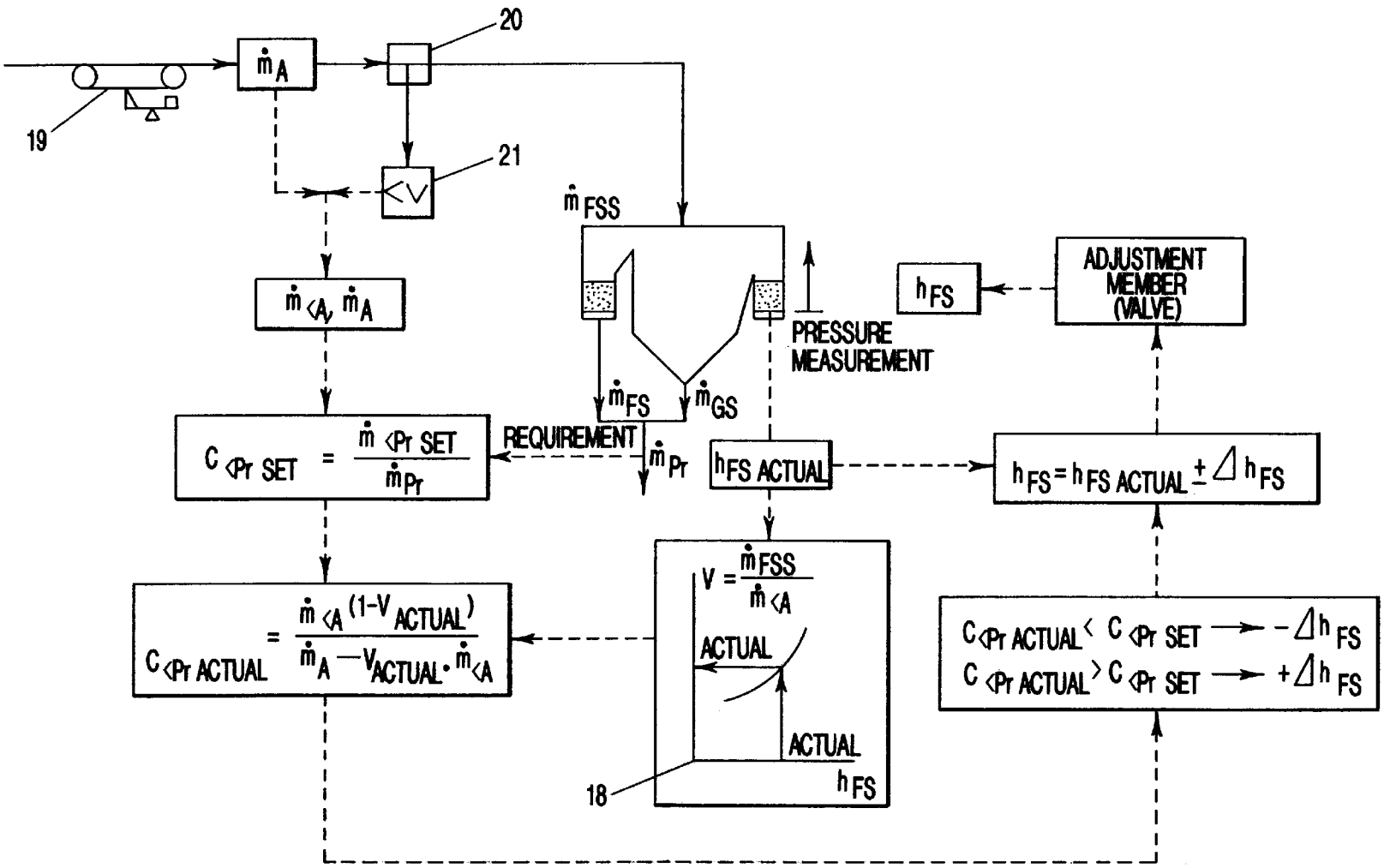
FIG. 3 the flow chart according to FIG. 2 for an alternative formation of the fluidized bed level, FIG. 4 a diagrammatic flow chart of the formation of the fluidized bed level as a function of the mass flows determined by measurements using belt scales.

The procedure illustrated in FIG. 3 is based in the same manner on set values or actual values for the concentration C, whereby a fixed $\Delta h_{FS}$ is pre-set incrementally. By way of an appropriate multiple adaptation an approximation to the set value can be achieved for the fluidized bed level $h_{FS}$ in the fine sand chamber 14.

Figure 4:
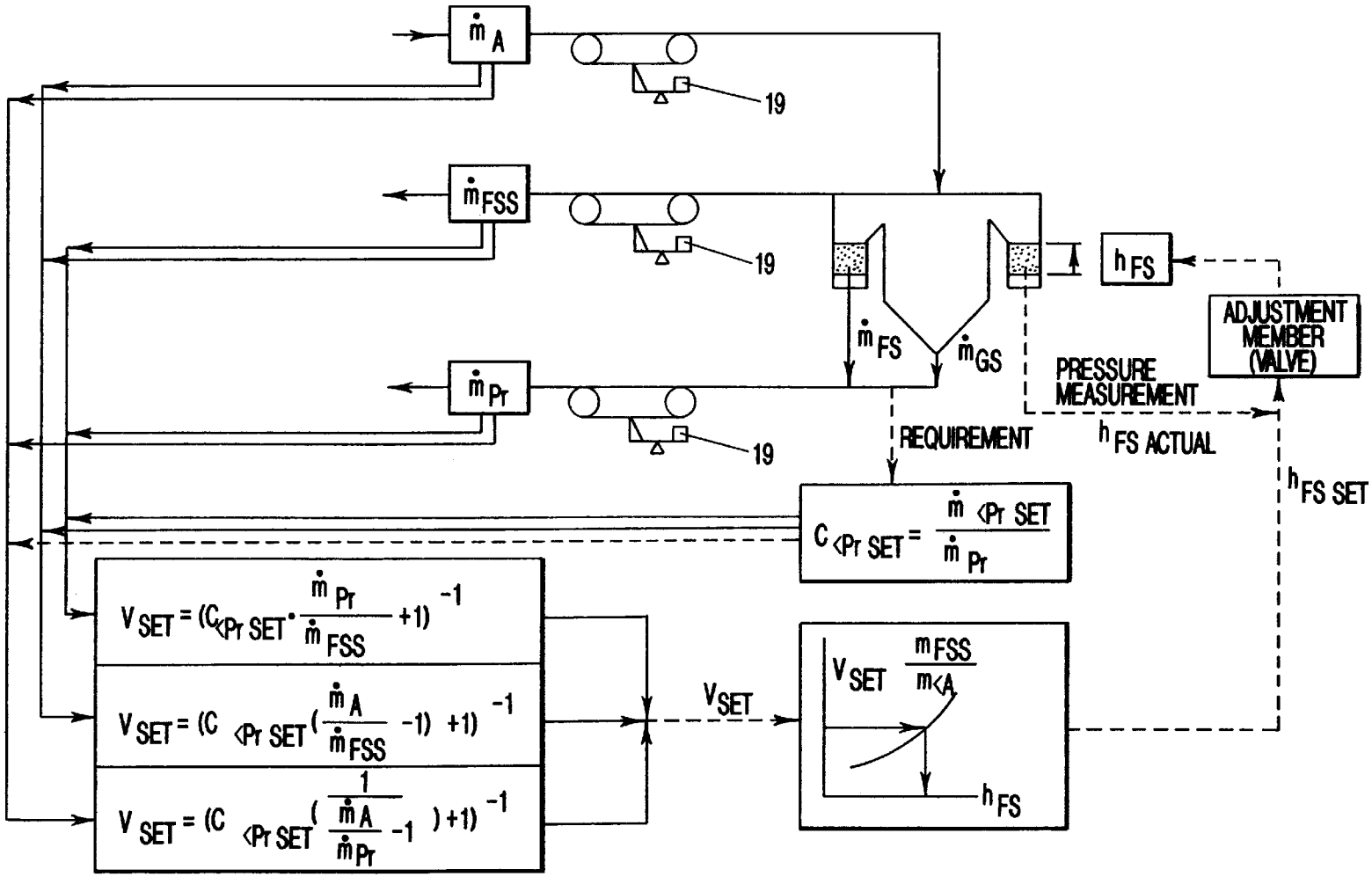

FIG. 4 shows an alternative for the process according to the invention in which it is possible to dispense with sample taking and particle size determination. The mass detection alone makes it possible to control the fluidized bed level of the fluidized bed, whereby of the available mass flows two parameters each are measured by belt scales 19. In this respect, the flow chart according to FIG. 4 contains three possible working examples with different combinations of respectively two of the three possible parameters. By the correlation of two measured mass flows $\dot{m}_A$ and/or $\dot{m}_{FSS}$ and/or $\dot{m}_{Pr}$, the set value for the loss factor, that is to say the discharge distribution, can be determined. According to the so determined set value for the loss factor V the set value for the fluidized bed level can be read directly off the diagram 18, permitting readjustment.

Figure 5:
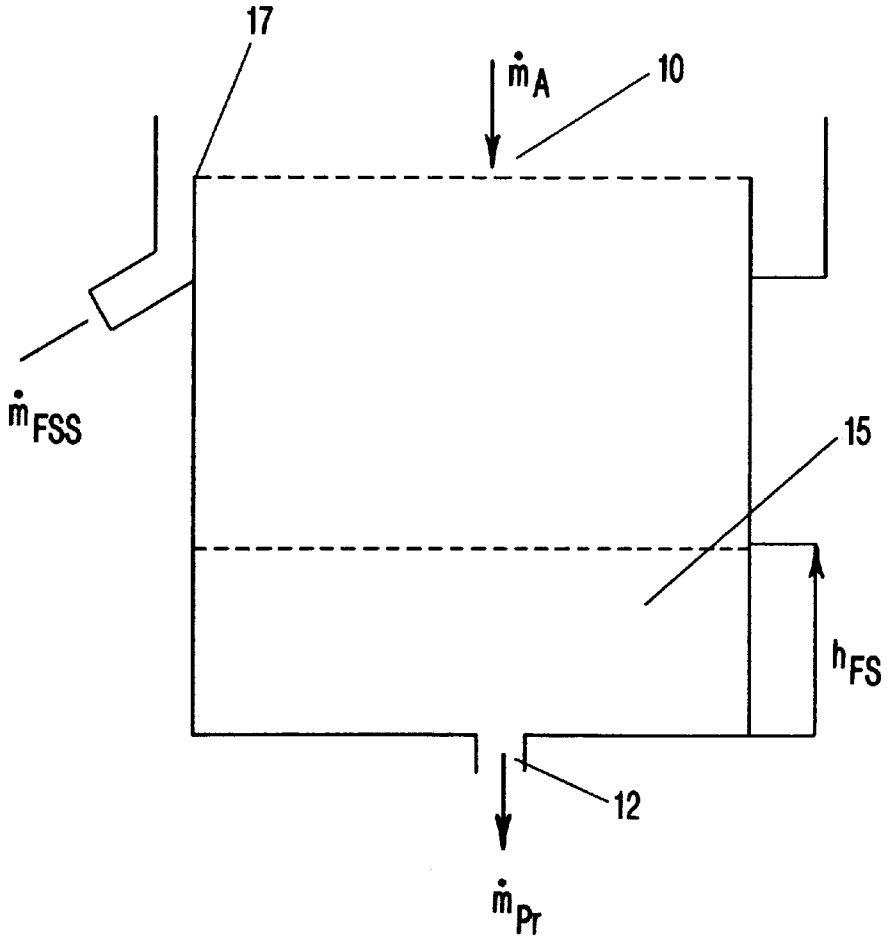
FIG. 5 a schematic representation of the correlation of the mass balance in an apparatus embodied with a single chamber.
Figure 6:
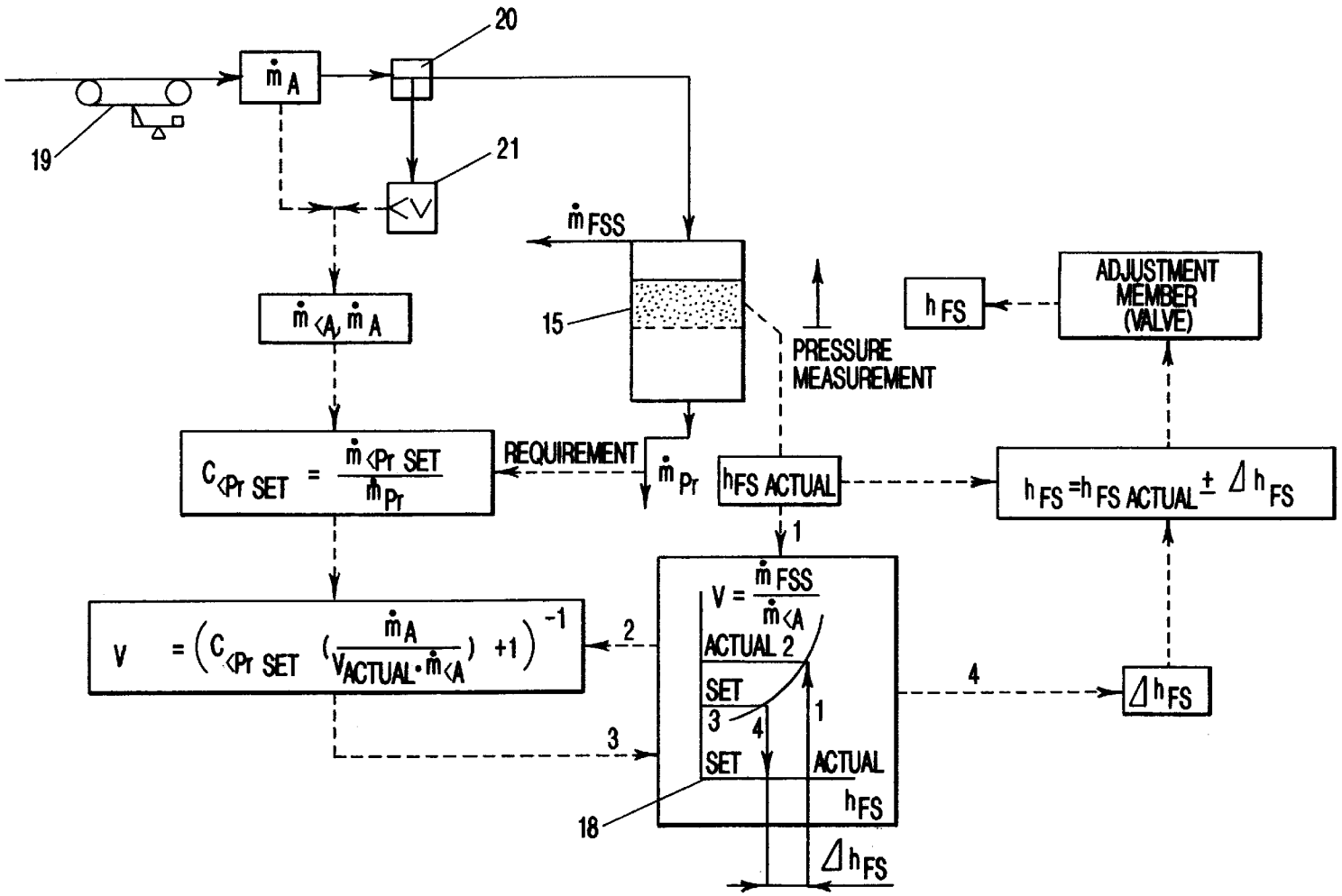
FIG. 6 the flow chart according to FIG. 2 applied to the apparatus of FIG. 5.

As is illustrated in FIGS. 5 and 6, the design of an apparatus comprising a single fluidized bed chamber is likewise possible, whereby the entire sand product mass $\dot{m}_{Pr}$ in this case is available directly as the yield from the chamber.

FIG. 5 shows the mass ratios for a device with a cylindrical single chamber receptacle in which the coarse sand chamber 11 and the fine sand chamber 14 are combined in one chamber whereby in the lower area of the chamber the fluidized bed 15 having a fluidized bed level $h_{FS}$ will be generated. Via the removal device 12 provided at the bottom of the receptacle the sand product mass $\dot{m}_{Pr}$ comprising the coarse sand portion and the fine sand portion is removed.

FIG. 6 shows in a representation corresponding to FIG. 2 the conditions resulting within the single chamber receptacle according to FIG. 5, wherein the relationships shown in FIG. 2 between the individual parameters do not change because only the sand product mass $\dot{m}_{Pr}$ is entered as a single parameter and this sand product mass is directly at hand for a single chamber receptacle in the form of the single product stream from the removal device 12.

The features of the object of these documents as disclosed in the above description, the claims, the abstract, and the drawing may be important individually as well as in any desired combination for the realization of the invention in its various embodiments.

The specification incorporates by reference the entire disclosure of German priority document 196 30 085.1 of Jul. 26, 1996, and International Application PCT/DE97/01568 of Jul. 19, 1997.

The present invention is, of course, in no way restricted to the specific disclosure of the specification and drawings, but also encompasses any modifications within the scope of the appended claims.

What is claimed is:

1. Process for controlling the product composition in an apparatus for sizing and sorting mineral raw materials, comprising a feed means for the raw material feed and at least one chamber serving for the separation of low density materials from the sand product fraction, including a sand product removal means and an overflow for the low density materials, the chamber being designed to operate as a sorting region according to the fluidized bed process in order to sort the raw material feed, said process comprising the steps of:

performing in the chamber (14) by means of the level ($h_{FS}$) of the fluidized bed (15) present in the chamber additionally a sizing separation of the sand fraction into a sand product mass ($\dot{m}_{Pr}$) and into a micro particle sand fraction ($\dot{m}_{FSS}$), to be discharged via the overflow (17);

controlling, for the adjustment of a pre-set concentration of micro particle sand in the sand product mass ($C_{<Prsoll}$), the fluidized bed level ($h_{FS}$) such that the micro particle sand fraction ($m_{<A}$) in the supplied raw material mass is divided, by means of the fluidized bed (15), as a function of the pre-set admissible concentration ($C_{<Prsoll}$) into a micro particle sand fraction ($m_{<PR}$) to be discharged into the sand product mass ($m_{Pr}$) and a micro particle sand fraction ($m_{FSS}$) to be discharged via the overflow (17);

predetermining, for all geometrically similar constructive designs of the apparatus, the fixed yield distribution (V), defined as a ratio of the micro particle sand fraction ($m_{FSS}$) to be removed to the micro particle sand fraction ($m_{<A}$) in the supplied raw material mass, as a function of the fluidized bed level ($h_{FS}$) in the form of a calibration curve as a parameter specific to the apparatus; and, deriving, based on the calibration curve, the fluidized bed level ($h_{FS}$), corresponding to the required yield distribution ($V_{soll}$) as a function of the determined micro particle sand content ($m_{<A}$) in the supplied raw material mass, as a set value for the level adjustment of the fluidized bed (15) present in the chamber (14).

2. Process according to claim 1, for an apparatus comprising an interior chamber serving as a coarse sand chamber for the separation of the coarse sand and an exterior chamber serving as a fine sand chamber for sorting the fine sand according to the fluidized bed process and connected to the coarse sand chamber via an overflow, designed as an inclined surface, and further comprising an overflow means for low-density materials associated with the exterior chamber, said process further comprising the step of:

performing additionally a sizing separation of the fine sand fraction into a micro particle sand fraction to be introduced into the fine sand product mass ($m_{FS}$) and into a micro particle sand fraction ($m_{FSS}$) to be discharged via the overflow (17) in the fine sand chamber (14) via the fluidized bed level of the fluidized bed (15) present in the chamber, wherein the yield distribution (V) for the fine sand chamber (14) is pre-set as a parameter specific to the apparatus.

3. Process according to claim 1, further comprising the steps of determining directly the micro particle sand content in the raw material feed ($m_A$) as a starting value by taking a sample and carrying out a particle size analysis of the sample taken.

4. Process according to claim 3, further comprising the steps of directly determining the fluidized bed level ($h_{FS}$) as the set value and determining the degree of the required readjustment ($\Delta h_{FS}$) for the fluidized bed level by comparison with the measured actual value.

5. Process according to claim 3, further comprising the step of performing, by means of an appropriately set degree of the readjustment ($\Delta h_{FS}$) for the fluidized bed level, an approximation of the measured actual value of the fluidized bed level to the set value corresponding to the required yield distribution (V).

6. Process according to claim 1, further comprising the steps of determining the yield distribution (V) as a function of the amounts measured for the raw material being fed ($m_A$) and/or the sand product mass ($m_{Pr}$) and/or the micro particle sand mass ($m_{FSS}$) discharged via the overflow and deriving the fluidized bed level ($h_{FS}$) as the desired value as a function of the yield distribution (V).

7. Process according to claim 6, further comprising the step of measuring the amounts for the raw material feed and/or the sand product mass and/or the micro particle sand mass by means of in-line belt scales (19).

8. Process according to claim 1, wherein the particle size limit between the micro particle sand fraction and the fine sand fraction is 0.25 mm.

* * * * *

UNITED STATES PATENT AND TRADEMARK OFFICE

CERTIFICATE OF CORRECTION

PATENT NO : 6,142,311
DATED : Nov. 7, 2000
INVENTOR(S): Rolf Körber

It is certified that error appears in the above-identified patent and that said Letters Patent are hereby corrected as shown be'ow:

On the Title page, the following item(s) should read as follows:

[73] Assignee:

Allmineral Aufbereitungstechnik GmbH & Co. KG

[30] Foreign Application Priority Data:

July 26, 1996 [DE] Germany.....196 30 085

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*